US005839964A

United States Patent [19]

Rudell et al.

[11] Patent Number: 5,839,964

[45] Date of Patent: Nov. 24, 1998

[54] WATER TOY RELEASE MECHANISM

[75] Inventors: Elliot Rudell, Torrance; George Foster, Long Beach; Joseph Cernansky, Palos Verdes Estates, all of Calif.

[73] Assignee: Elliot A. Rudell, Torrance, Calif.

[21] Appl. No.: 808,476

[22] Filed: Mar. 3, 1997

[51] Int. Cl.[6] ..... A63G 21/18

[52] U.S. Cl. ..... 472/117; 472/128

[58] Field of Search ..... 472/116, 117, 472/128, 129, 52; 446/89, 475

[56] References Cited

U.S. PATENT DOCUMENTS

| | | | |
|---|---|---|---|
| 3,577,675 | 5/1971 | Kohner | 446/227 |
| 3,866,916 | 2/1975 | Clarke | 472/128 X |
| 5,135,440 | 8/1992 | Smollar et al. | 472/128 |
| 5,154,671 | 10/1992 | Smollar et al. | 472/117 |
| 5,263,714 | 11/1993 | Rudell et al. . | |
| 5,405,294 | 4/1995 | Briggs | 472/128 |

*Primary Examiner*—Kien T. Nguyen
*Attorney, Agent, or Firm*—Blakely Sokoloff Taylor & Zafman

[57] ABSTRACT

A water game that periodically releases a volume of water. The game includes a trough that is pivotally connected to a stand. The trough is in fluid communication with a source of water such as a garden hose that is attached to the stand. The hose provides water that fills the trough. The water trough has a cavity that is offset from the stand so that the trough pivots about the stand and releases a volume of water when the water reaches a certain level. The trough rotates back into an upright position and again becomes filled with water, wherein the process is repeated. The stand can support the trough above a mat. A game participant can slide across the mat as the trough releases water to simulate a "riding of a wave".

13 Claims, 3 Drawing Sheets

WATER TOY RELEASE MECHANISM

BACKGROUND OF THE INVENTION

1. Field of the Invention

The present invention relates to a toy water game that periodically releases water.

2. Description of Related Art

There have been developed a number of water games which can be played outdoors and allow the participants to become wet. For example, Marchon and Wham-O marketed products under the trademarks CROCODILE MILE and SLIP N SLIDE, respectively, which included a long vinyl mat that was lubricated with water by a sprinkler head. The participants would slide across the wet mat. CROCODILE MILE and SLIP N SLIDE did not require any particular skill other than the ability to slide across a wet mat.

Larami Corp. marketed a product under the trademark SUPER SOAKER TWISTER which included a mat that contained a plurality of internal passages that provided fluid communication between a garden hose and a plurality of apertures in the mat. The participants played a game of "TWISTER" while water squirted up through the apertures of the mat.

Mattel Toys has marketed a game under the trademark WETHEAD which included a helmet that was worn by a participant. The WETHEAD contained a number of sticks that could be pulled out of the helmet. One of the released sticks would release water onto the participant wearing the helmet. U.S. Pat. No. 5,273,714 issued to Rudell et al. discloses a game shaped as an octopus which has a plurality of "tenticles" that can be pivoted into a down position. One of the activated tenticles releases a stream of water.

SUMMARY OF THE INVENTION

The present invention is a water game that periodically releases a volume of water. The game includes a trough that is pivotally connected to a stand. The trough is in fluid communication with a source of water such as a garden hose that is attached to the stand. The hose provides water that fills the trough. The water trough has a cavity that is offset from the stand so that the trough pivots about the stand and releases a volume of water when the water reaches a certain level. The trough rotates back into an upright position and again becomes filled with water, wherein the process is repeated. The stand can support the trough above a mat. A game participant can slide across the mat as the trough releases water to simulate a "riding of a wave".

DETAILED DESCRIPTION OF THE INVENTION

Figure 1:
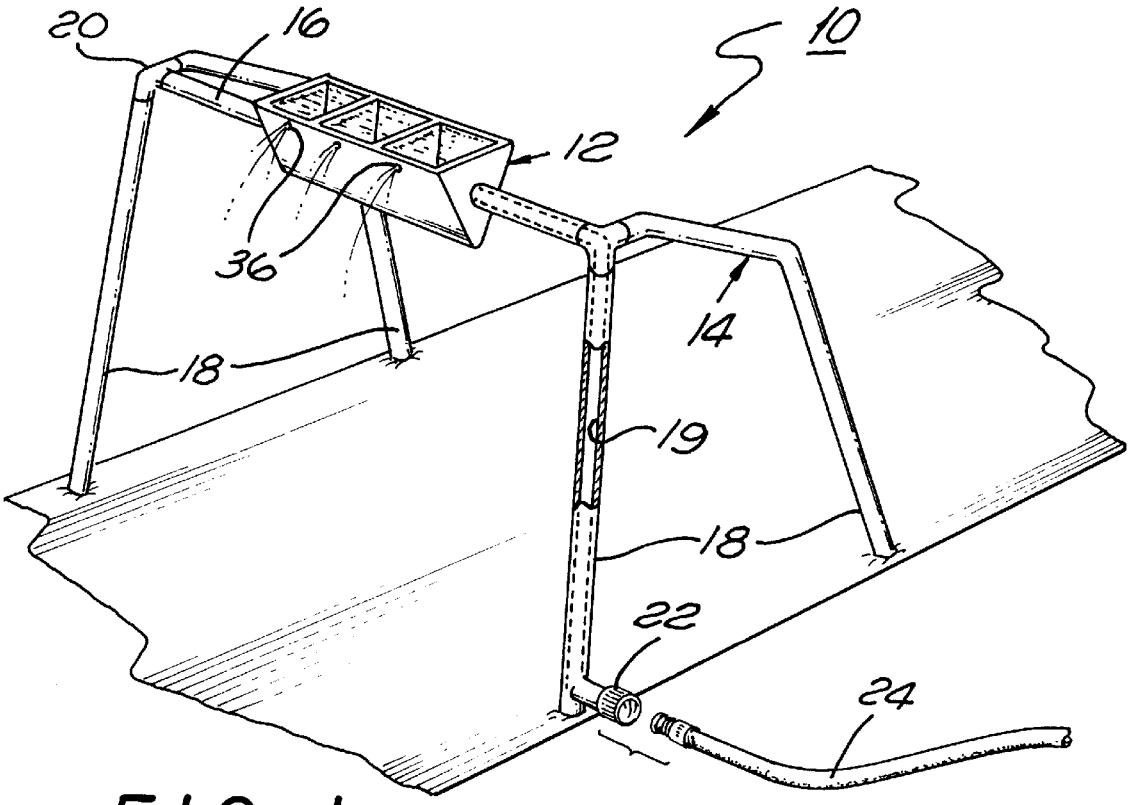
FIG. 1 is a perspective view of a water game of the present invention.

Referring to the drawings more particularly by reference numbers, FIG. 1 shows a water game 10 of the present invention. The game 10 periodically releases a volume of water. The game 10 includes a trough 12 that is pivotally connected to a stand 14. The stand 14 includes a center bar 16 that is attached to a plurality of legs 18. In the preferred embodiment, the center bar 16 and legs 18 are constructed from hollow molded plastic tubes that each have an inner channel 19. The bar 16 and legs 18 can be joined together by T-shaped sections 20. One of the legs 18 has a garden hose connector 22 that can be attached to a garden hose 24.

Figure 2:
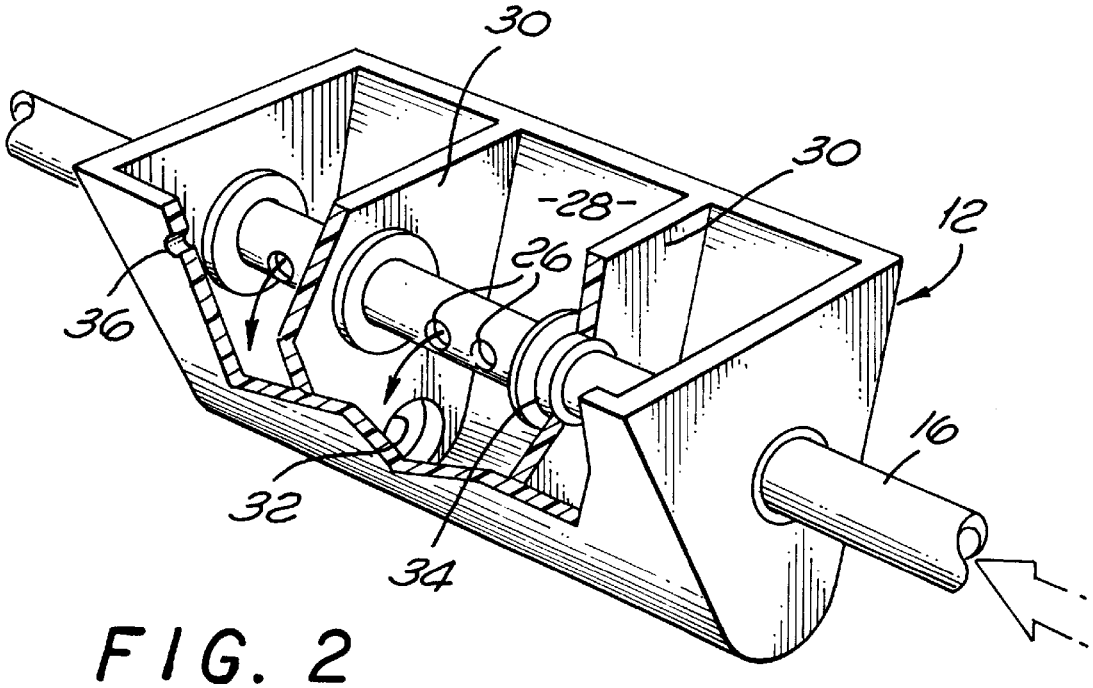
FIG. 2 is an enlarged view of a trough of the water game.
Figure 3A:
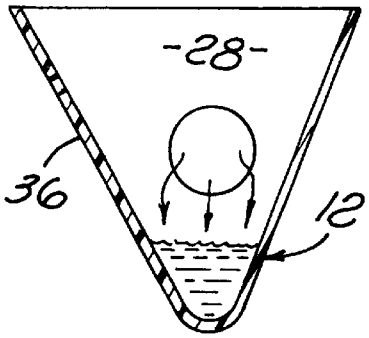
FIGS. 3*a–d* show a trough being filled with water and pivoting about a stand to release a volume of water.
Figure 3B:
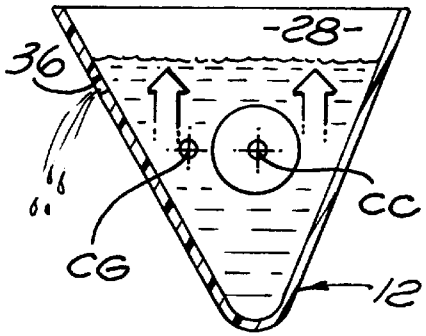
Figure 3C:
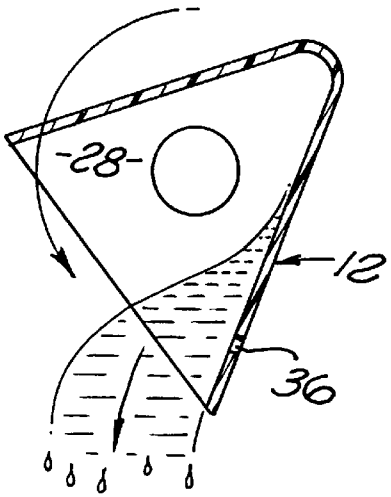
Figure 3D:
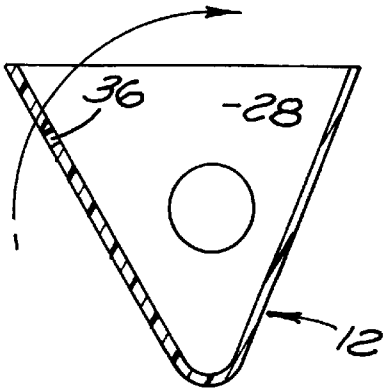

As shown in FIG. 2 the center bar 16 has a plurality of openings 26 that allow water to flow into a cavity 28 of the trough 12. In the preferred embodiment the cavity 28 is separated into three separate chambers by walls 30. The walls 30 may have openings 32 to provide fluid communication between the chambers. The trough 12 rotates about a plurality of bearing collars 34 that are attached to the center bar 16. The bearing collars 34 may be constructed from a low friction material such as DELRIN. As shown in FIG. 1 the trough 12 may have a plurality of openings 36. The openings 36 allow water to flow out of the cavity 28 and provide an indication that the trough 12 will rotate about the stand 14.

FIGS. 3*a–d* show the operation of the trough 12. The cavity 28 is filled with water provided from the garden hose 24. When the water level reaches a certain level, the center of gravity of the water CG is offset from the center of the center bar CC so that the trough 12 rotates about the bar 16. Rotation of the trough 12 releases the water from the cavity 28. The openings 36 allow water to flow out of the cavity 28 to provide an indication that the trough 12 is about to tip over. The center of gravity of the trough 12 is such that the trough 12 will rotate back to the upright position when the water is released from the cavity 12. The cavity 28 is again filled with water and the process is repeated.

Figure 4:
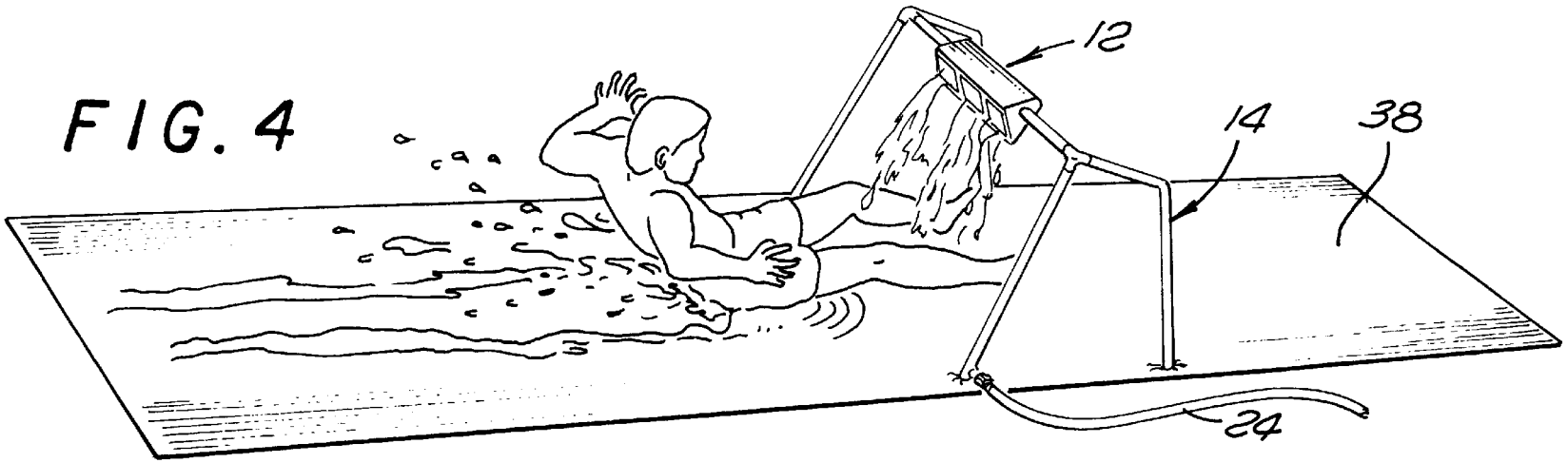
FIG. 4 is a perspective view showing a participant sliding across a mat.

As shown in FIG. 4 the trough 12 can be supported above a long mat 38. The mat 38 can be constructed from a low friction vinyl or polyethylene sheet. The trough 12 releases water onto the mat 38 to provide a wet surface. A participant can slide across the slippery mat 38. The participant can time his slide so that he crosses under the stand 14 while the trough 12 is releasing water onto the mat 12 to simulate "riding a wave". Water flowing from the openings 36 provide an indication of when the trough 12 will rotate so that the participant can accurately time his slide.

Figure 5:
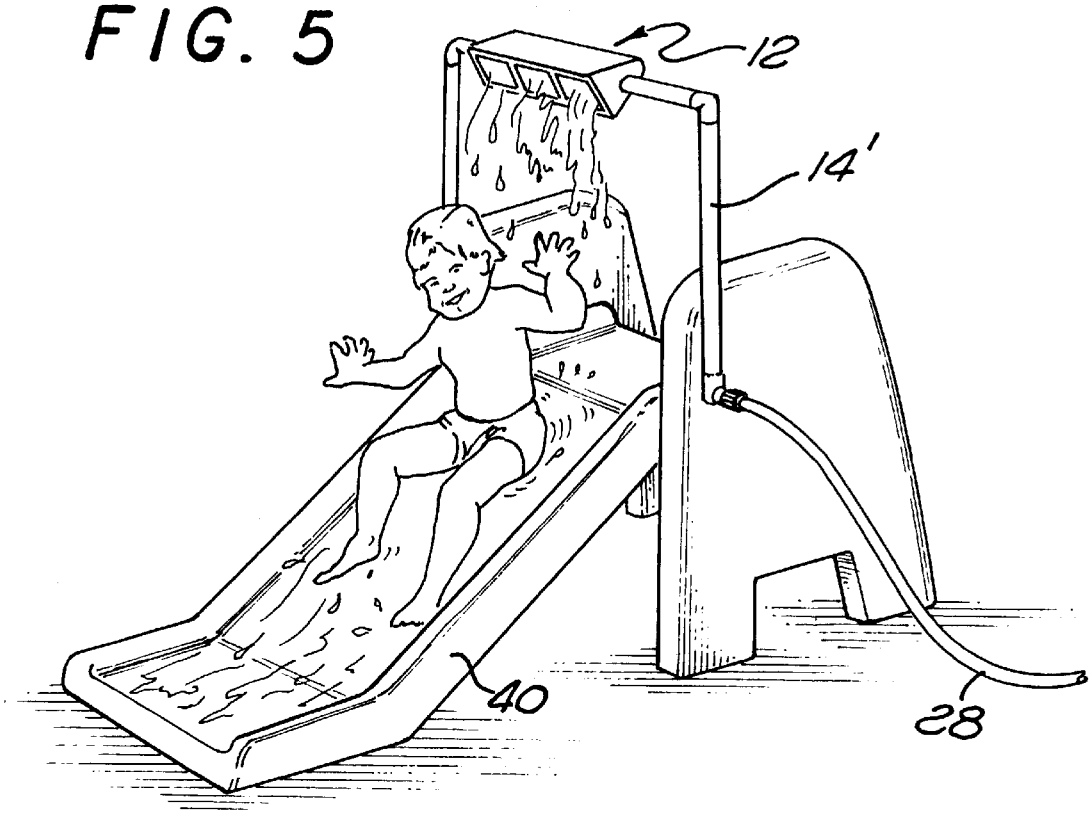
FIG. 5 is a perspective view showing the trough and stand on a slide.
Figure 6:
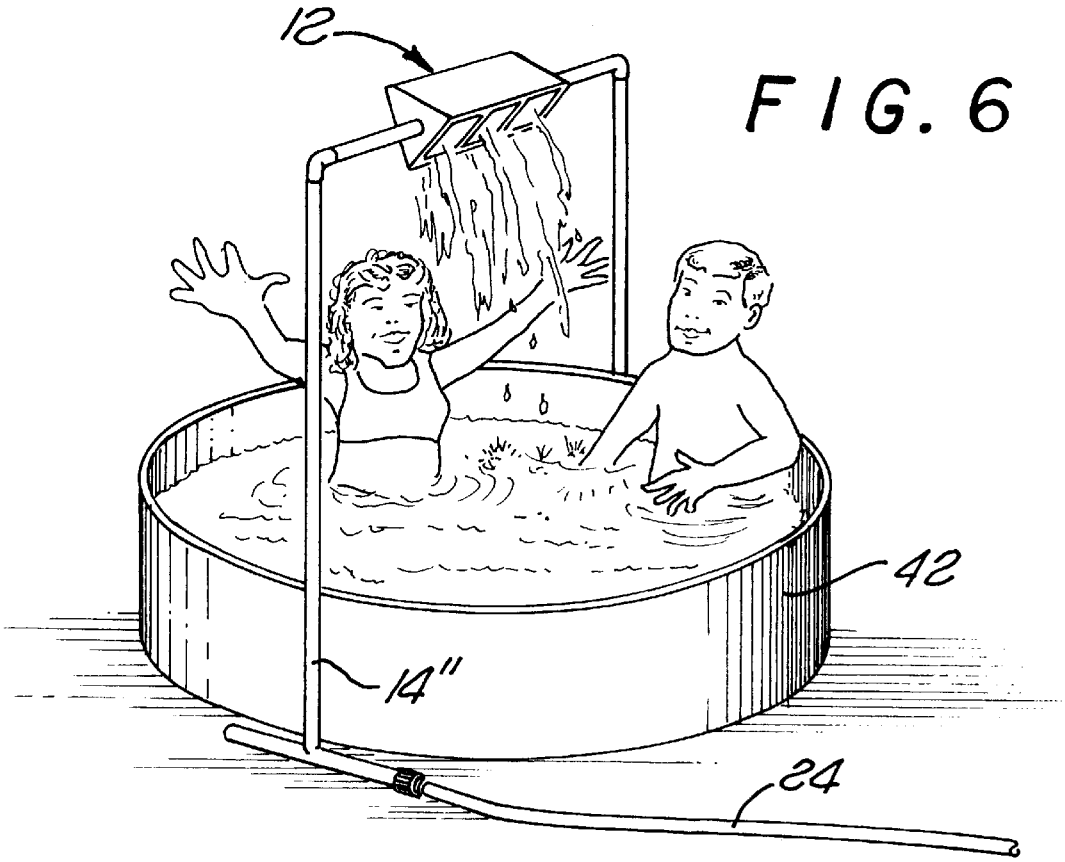
FIG. 6 is a perspective view showing the trough and stand in a wading pool.

FIG. 5 shows the stand 14' and trough 12 attached to a slide 40. The trough 12 can periodically release water onto the slide 40 to create a wet surface. FIG. 6 shows a stand 14" and a trough 12 located above a wading pool 42.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A water toy that periodically dumps a volume of water provided by a source of water, comprising:

a stand that includes a center bar which has an opening in fluid communication with the source of water; and, a trough that is pivotally connected to said center bar said trough having a cavity that receives water which flows through said opening of said center bar until the water reaches a certain level, wherein said cavity is offset from said center bar so that said trough automatically pivots about said center bar to release a volume of water.

2. The water toy as recited in claim 1, wherein said stand includes a leg that has a garden hose connector that is in fluid communication with said opening that provides fluid communication between the source of water and said cavity.

3. The water toy as recited in claim 1, wherein said trough has an opening that allows a stream of water to be emitted from said cavity before said trough pivots about said stand.

4. The water toy as recited in claim 1, further comprising a mat that is located below said trough.

5. The water toy as recited in claim 1, further comprising a slide that supports said stand.

6. The water toy as recited in claim 1, further comprising a pool that collects the water released by said trough.

7. A water toy that periodically dumps a volume of water provided by a source of water, comprising:

a stand that has a center bar that is attached to a plurality of legs, wherein said center bar has an opening that is in fluid communication with the source of water; and, a trough that is pivotally connected to said center bar, said trough having a cavity that receives the water which flows through said center bar opening until the water reaches a certain level, wherein said trough pivots about said stand to release a volume of water.

8. The water toy as recited in claim 7, wherein said cavity is offset from said center bar.

9. The water toy as recited in claim 7, wherein said trough has an opening that allows a stream of water to be emitted from said cavity before said trough pivots about said stand.

10. The water toy as recited in claim 7, further comprising a mat that is located below said trough.

11. The water toy as recited in claim 7, further comprising a slide that supports said stand.

12. The water toy as recited in claim 7, further comprising a pool that collects the water released by said trough.

13. A method for sliding across a mat, comprising the steps of:

a) placing a trough above a mat, wherein said trough is filled with water, and periodically and automatically pivots about a stand to release a volume of water onto said mat; and, b) sliding across said mat when the water is released onto said mat.

* * * * *